US005916852A

United States Patent [19]

Nibert et al.

[11] Patent Number: 5,916,852

[45] Date of Patent: Jun. 29, 1999

[54] POWER TRANSMISSION FLUIDS WITH IMPROVED FRICTION BREAK-IN

[75] Inventors: Roger Keith Nibert, Hampton; Raymond F. Watts, Long Valley, both of N.J.

[73] Assignee: Exxon Chemical Patents Inc., Linden, N.J.

[21] Appl. No.: 08/922,810

[22] Filed: Sep. 2, 1997

[51] Int. Cl.[6] ..... C10M 137/02

[52] U.S. Cl. ..... 508/432; 508/419; 508/434; 508/545

[58] Field of Search ..... 508/421, 434, 508/429, 564, 419, 545, 432

[56] References Cited

U.S. PATENT DOCUMENTS 5,484,543 1/1996 Chandler et al. ..... 508/454

FOREIGN PATENT DOCUMENTS 407124 1/1991 European Pat. Off. .

*Primary Examiner*—Jacqueline V. Howard
*Assistant Examiner*—Cephia D. Toomer
*Attorney, Agent, or Firm*—Ohlandt, Greeley, Ruggiero & Perle

[57] ABSTRACT

The present invention generally pertains to a power transmission fluid composition comprising: (a) a major amount of lubricating oil; (b) an oil soluble phosphorus compound; (c) an ashless dispersant; and (d) an amine (i.e., alkyl primary amine) having the following Structure I:

$$R—NH_2$$

wherein R is about a $C_8$ to $C_{30}$ alkyl. Optionally, the power transmission fluid composition may include an amine containing friction modifier.

22 Claims, No Drawings

POWER TRANSMISSION FLUIDS WITH IMPROVED FRICTION BREAK-IN

The present invention relates to a composition and a method of improving the break-in frictional characteristics of power transmitting fluids, particularly automatic transmission fluids.

BACKGROUND OF THE INVENTION

Providing fluids with the proper frictional characteristics for power transmitting devices is the responsibility of the fluid formulator. There are three aspects to producing fluids with the proper frictional characteristics. The first is having the correct friction break-in at the moment of initial fill of the device. The second is having appropriate friction after a short break-in period and the third is maintaining those frictional characteristics for long periods of time. This third characteristic is often referred to as friction durability. The present invention is concerned with the first of these properties, i.e., friction break-in.

Formulating power transmission fluids to very exacting friction requirements is a very difficult process. In the case of fluids used for initial fill, i.e. factory fill, of transmissions this problem is made more difficult because all of the components of the system, fluid, friction material and steel running surface are new. That is, they have experienced no conditioning under the conditions of operation of the system. Therefore, for the first several hours up to the first thousand miles of operation, the frictional characteristics of the system are constantly changing. Typically, fluid formulation is done to provide the ideal frictional characteristics in the "broken-in" or aged system.

The continuing search for methods to improve overall vehicle fuel economy has identified the torque converter, or fluid coupling, used between the engine and automatic transmission, as a relatively large source of energy loss. Since the torque converter is a fluid coupling it is not as efficient as a solid disk type clutch. At any set of operating conditions (e.g., engine speed, throttle position, ground speed, or transmission gear ratio), there is a relative speed difference between the driving and driven members of the torque converter. This relative speed differential represents lost energy which is dissipated from the torque converter as heat.

One method of improving overall vehicle fuel economy used by transmission manufacturers is to incorporate into the torque converter a clutch mechanism capable of "locking" the torque converter. "Locking" refers to eliminating relative motion between the driving and driven members of the torque converter so that no energy is lost in the fluid coupling. These "locking" or "lock-up" clutches are very effective at capturing lost energy at high road speeds. However, when lock-up clutches are used at low road speeds vehicle operation is rough and engine vibration is transmitted through the drive train. Rough operation and engine vibration are not acceptable to drivers.

The higher the percentage of time that the vehicle can be operated with the torque converter clutch engaged, the more fuel efficient the vehicle becomes. A second generation of torque converter clutches have been developed which operate in a "slipping" or "continuously sliding mode". These devices have a number of names, but are commonly referred to as continuously slipping torque converter clutches. The difference between these devices and lock-up clutches is that they allow some relative motion between the driving and driven members of the torque converter, normally a relative speed of 10 to 100 rpm. This slow rate of slipping allows for improved vehicle performance as the slipping clutch acts as a vibration damper. Whereas the "lock-up" type clutch could only be used at road speeds above approximately 50 mph, the "slipping" type clutches can be used at speeds as low as 25 mph, thereby capturing significantly more lost energy. It is this feature that makes these devices very attractive to vehicle manufacturers.

However, continuously slipping torque converter clutches impose very exacting friction requirements on automatic transmission fluids (ATF's) used with them. The fluid must have a very good friction versus velocity relationship. The parameter commonly used to quantify a fluid's friction versus velocity relationship is the change of friction with sliding speed, $\Delta\mu/\Delta v$. For the continuously slipping torque converter clutch to operate properly friction must always increase with increasing speed, a positive $\Delta\mu/\Delta v$. If friction decreases with increasing speed, a negative $\Delta\mu/\Delta v$, then a self-exciting vibrational state can be set up in the driveline. This phenomenon is commonly called "stick-slip" or "dynamic frictional vibration" and manifests itself as "shudder" or low speed vibration in the vehicle. Clutch shudder is very objectionable to the driver.

A fluid which allows the vehicle to operate without vibration or shudder is said to have good "anti-shudder" characteristics. Not only must the fluid have an excellent friction versus velocity relationship when it is new, it must retain those frictional characteristics over the lifetime of the fluid, which can be the lifetime of the transmission. The longevity of the anti-shudder performance in the vehicle is commonly referred to as "anti-shudder durability".

When the continuously slipping torque converter mechanism is installed in the new vehicle and the vehicle operated for the first several minutes, up to the first several hundred miles, the device must operate as designed, and be free from shudder. During this break-in, or run-in, many changes are occurring in the components of the continuously slipping torque converter clutch. The steel running surface is wearing, friction material is being worn, resins in the friction material, e.g., a friction disk, are further cured and fluid is beginning to age at the high operating temperatures. All of these changes affect the overall frictional characteristics of the system. In order for the continuously slipping clutch to operate properly, the correct friction versus velocity relationship must be established and maintained all throughout this break-in period, and beyond. Shudder which occurs during the break-in period is commonly referred to as "green shudder".

What the present inventors have discovered is that by employing an oil-soluble phosphorus compound, an ashless dispersant and a long chain alkyl primary amine, power transmitting fluids with excellent break-in friction characteristics can be produced.

SUMMARY OF THE INVENTION

The present invention relates to a composition and method of improving the frictional break-in of a power transmitting fluid. This unique power transmitting fluid preferably comprises: (1) a major amount of a lubricating oil; and (2) a break-in improving effective amount of an additive combination preferably comprising: (a) an oil-soluble phosphorus compound; (b) an ashless dispersant; (c) an amine (i.e., an alkyl primary amine) represented by the following general formula (I):

$$R—NH_2 \quad (I)$$

wherein R is about a $C_8$ to $C_{30}$ alkyl, preferably a $C_{10}$ to $C_{18}$ alkyl; and, (d) optionally, an amine containing friction modifier. The power transmitting fluid may also include additional additives selected from the group consisting of: viscosity index improvers, corrosion inhibitors, dispersants, antifoaming agents, detergents, antiwear agents, pour point depressants, and seal swellants.

The phosphorus compound is preferably either (a) a mixture of mono- and di-alkyl phosphites or (b) an ashless dispersant reacted with phosphorus esters, phosphorus-based acids, or a mixture thereof.

The amine of structure I is typically at least one amine selected from the group consisting of: oleyl amine, decyl amine, iso-decyl amine, dodecyl amine, tetradecylamine, octadecyl amine, eicosylamine, oleyl amine, cocoa amine, soya amine, tallow amine, hydrogenated tallow amine, stearyl amine, and iso-stearyl amine.

The amine containing friction modifier is preferably selected from the group consisting of: the di-(-iso-stearyl amide) of tetraethylene pentamine, the di-(iso-octadecenyl succinimide) of diethylene triamine, and N,N-bis(2-hydroxylethyl)-hexadecyloxypropylamine.

The lubricating oil is preferably synthetic oil or mixture of synthetic and natural mineral oils.

In accordance with another embodiment of the present invention, the power transmission fluid may be one that comprises the product formed by adding the following components: (a) a major amount of lubricating oil having a kinematic viscosity of from about between about 1 $mm^2/s$ to 100 $mm^2/s$ at 100° C., more preferably between about 1 $mm^2/s$ to 40 $mm^2/s$ at 100° C., and most preferably between about 2 $mm^2/s$ to 8 $mm^2/s$ at 100° C.; (b) an oil soluble phosphorus compound; and (c) an amine having the following Structure I:

$$R—NH_2$$

wherein R is a $C_8$ to $C_{30}$ alkyl.

The present invention also pertains to a method for eliminating or substantially reducing green shudder in power transmissions which comprises: adding to a power transmission during initial fill a power transmission fluid composition comprising: (a) a major amount of lubricating oil having a kinematic viscosity of from about between about 1 $mm^2/s$ to 40 $mm^2/s$ at 100° C.; (b) an oil soluble phosphorus compound; (c) an ashless dispersant; and (d) an amine having the following Structure I:

$$R—NH_2$$

wherein R is a $C_8$ to $C_{30}$ alkyl.

Alternatively, the present invention also pertains to a method for eliminating or substantially reducing green shudder in power transmissions which comprises: adding to a power transmission during initial fill a power transmission fluid that comprises the product formed by adding the following components: (a) a major amount of lubricating oil having a kinematic viscosity of from about between about 1 $mm^2/s$ to 40 $mm^2/s$ at 100° C.; (b) an oil soluble phosphorus compound; and (c) an amine having the following Structure I:

$$R—NH_2$$

wherein R is a $C_8$ to $C_{30}$ alkyl.

DETAILED DESCRIPTION OF THE PREFERRED EMBODIMENT

The present inventors have unexpectantly discovered that lubricating fluids which include an additive combination comprising a compound having the general formula $R—NH_2$ with oil-soluble phosphorus compounds, an ashless dispersant, and, optionally, other amine containing friction modifiers provide lubricating fluids which exhibit excellent break-in characteristics that are capable of preventing green shudder in automatic transmissions.

While the present invention has been demonstrated for a particular power transmitting fluid, i.e., an automatic transmission fluid (ATF) as being effective in eliminating or substantially reducing green shudder, it is contemplated that the benefits exhibited therein are equally applicable to other power transmitting fluids. Examples of other types of power transmitting fluids include, but are not limited to, gear oils, hydraulic fluids, heavy duty hydraulic fluids, industrial oils, power steering fluids, pump oils, tractor fluids, universal tractor fluids, and the like. These power transmitting fluids can be formulated with a variety of performance additives and in a variety of base oils.

Assuming that the power transmission fluid has been formulated with the correct friction properties for the successful operation of the transmission after break-in, then the only issue which the present inventors needed to address in their additive package was the prevention of green shudder as the system is initially aged. The present inventors have determined that green shudder is normally caused by the system exhibiting too high a static level of friction. This can be caused by incomplete curing of the resin on the friction elements, too rough a surface on the steel plate, or incomplete interaction of additives in the fluid used. When the device is first operated under load the high temperatures developed in the clutch tend to cure the resin, drive additive interactions in the fluid to completion and wear the steel surface to its optimal surface. The present inventors believe that control of green shudder then can be approached by simply lowering the static friction level of the system. However, the lowering of the static level of friction should only be temporary. The fluid should provide this lower static friction only for a short period of time, just long enough for the break-in processes to occur.

What the present inventors have unexpectantly discovered is that long chain aliphatic primary amines (i.e., amines represented by the following general formula:

$$R—NH_2$$

wherein R is a $C_8$ to $C_{30}$ alkyl) when used in conventionally formulated power transmission fluids containing oil soluble phosphorus compounds, ashless dispersants and, optionally, other amine containing friction modifiers, provide this transient lowering of static friction and, thus, prevents the occurrence of green shudder.

LUBRICATING OILS

Lubricating oils useful in the present invention are derived from natural lubricating oils, synthetic lubricating oils, and mixtures thereof. In general, the preferred natural and synthetic lubricating oils will each have a kinematic viscosity ranging from between about 1 to 100 $mm^2/s$ (cSt) at 100° C., more preferably between about 1 $mm^2/s$ to 40 $mm^2/s$ at 100° C., although the preferred applications will require each oil to have a kinematic viscosity ranging from between about 2 to 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks including oils that are naphthenic or paraffinic in chemical structure. Mineral oils may be those that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. Mineral oils may be those that are hydrotreated or hydrofined, dewaxed by chilling or catalytic dewaxing processes, or hydrocracked. Alternatively, mineral oils may be produced from natural crude sources or be composed of isomerized wax materials or residues of other refining processes.

Typically, mineral oils will have kinematic viscosities of from between about 2.0 $mm^2/s$ (cSt) to 8.0 $mm^2/s$ (cSt) at 100° C. The preferred mineral oil has kinematic viscosities of from between about 2 to 6 $mm^2/s$ (cSt), and most preferred are mineral oils with viscosities between about 3 to 5 $mm^2/s$ (cSt) at 100 ° C.

Synthetic lubricating oils preferably have a kinematic viscosity ranging from between about 1 $mm^2/s$ to 100 $mm^2/s$ at 100° C. Such synthetic lubricating oils include hydrocarbon oils and halo-substituted hydrocarbon oils, such as, oligomerized, polymerized and interpolymerized olefins; alkylbenzenes; polyphenyls; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-octene, 1-decene 1-dodecene and mixtures thereof.

The oligomerized, polymerized and interpolymerized olefins preferably include the following: polybutylenes, polypropylenes, propylene, isobutylene copolymers, chlorinated polylactenes, poly(1-hexenes), poly(1-octenes), poly-(1-decenes), etc., and mixtures thereof. The alkylbenzenes preferably include the following: dodecyl-benzenes, tetradecylbenzenes, dinonyl-benzenes, di(2-ethylhexyl) benzene, etc. The polyphenyls preferably include the following: biphenyls, terphenyls, alkylated polyphenyls, etc.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide. The alkyl and aryl ethers of these polyoxyalkylene polymers are preferably selected from either methyl-polyisopropylene glycol ether having an average molecular weight of 1000 or diphenyl ether of polypropylene glycol having a molecular weight of between about 1000 to 1500. The mono- and poly-carboxylic esters of these polyoxyalkylene polymers are preferably selected from the following: acetic acid esters, mixed $C_3$–$C_8$ fatty acid esters, and $C_{12}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils is adipates of $C_4$ to $C_{12}$ alcohols.

Esters useful as synthetic lubricating oils also include those made from $C_5$ to $C_{12}$ monocarboxylic acids, polyols and polyol ethers, such as, neopentyl glycol, trimethylolpropane pentaerythritol, dipentaerythritol, tripentaerythritol, and the like.

Silicon-based oils (such as, the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetra-hydrofurans, poly-α-olefins, and the like.

The lubricating oils may be derived from refined, re-refined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Re-refined oils are obtained by treating used oils in processes similar to those used to obtain the refined oils. These re-refined oils are also known as reclaimed or reprocessed oils and are often additionally processed by techniques for removal of spent additives and oil breakdown products.

When the lubricating oil is a mixture of natural and synthetic lubricating oils (i.e., partially synthetic), the choice of the partial synthetic oil components may widely vary. However, particularly useful combinations are comprised of mineral oils and poly-α-olefins (PAO), particularly oligomers of 1-decene.

OIL SOLUBLE PHOSPHORUS COMPOUNDS

Alkyl Phosphites

The alkyl phosphites useful in the present invention are the mono-, di- and tri-alkyl phosphites shown as structures (II), (III) and (IV) respectively. They are represented by the structures shown:

(II)

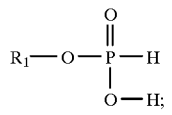

-continued (III)

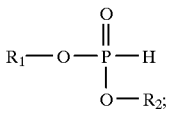

(IV)

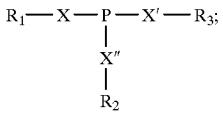

wherein: $R_1$, $R_2$ and $R_3$ are independently $C_4$ to $C_{30}$ hydrocarbyl, and X, X' and X" are independently oxygen or sulfur.

As used herein the term "hydrocarbyl" denotes a group having a carbon atom directly attached to the remainder of the molecule and having predominantly hydrocarbon character within the context of this invention. Such hydrocarbon groups include the following: aliphatic (e.g., alkyl or alkenyl), alicyclic (e.g., cycloalkyl of cycloalkenyl), aromatic aliphatic and alicyclic groups and the like, as well as cyclic groups wherein the ring is completed through another portion of the molecule. When R is aryl, the aryl groups consist of from 6 to 30 carbon atoms and contain at least one unsaturated "aromatic" ring structure. Examples include methyl, ethyl, octyl, decyl, octadecyl, cyclohexyl and phenyl, etc. Hydrocarbyl may also include substituted hydrocarbon groups, i.e., groups containing non-hydrocarbon substituents which in the context of the present invention, do not alter the predominantly hydrocarbon nature of the group. Those skilled in the art will be aware of suitable substituents. Examples include, halo, hydroxy, nitro, cyano, alkoxy, acyl, etc. The hydrocarbyl may also include hetero groups, i.e., groups which while predominantly hydrocarbon in character within the context of the present invention, contain atoms of other than carbon in a chain or ring otherwise composed of carbon atoms. Suitable hetero atoms will be apparent to those skilled in the art and include, for example, nitrogen, oxygen and sulfur. R can also vary independently. As stated above, R can be linear or branched alkyl or aryl groups. When R is an aryl group it is preferably phenyl or substituted phenyl. The R groups may be saturated or unsaturated, and they may contain hetero atoms such as sulfur, nitrogen or oxygen.

The preferred phosphites are mixtures of mono- (II) and di-alkyl phosphites (III). The R groups are preferably linear alkyl groups, such as octyl, decyl, dodecyl, tetradecyl and octadecyl. Most preferred are alkyl groups containing thio-ether linkages. Examples of these groups are 3-thio-heptane, 3-thio-nonane, 3-thio-undecane, 3-thio-tridecane, 5-thio-hexadecane, 8-thio-octadecane. The most preferred alkyl-phosphites of this invention are the thio-alkyl phosphites as described in U.S. Pat. No. 5,185,090 and U.S. Pat. No. 5,242,612 which are incorporated herein by reference.

While any effective amount of the alkyl phosphite may be used to achieve the benefits of this invention, typically these effective amounts will contribute to the finished fluid from between about 10 to 1000, preferably from between about 100 to 750, most preferably from between about 200 to 500 parts per million (ppm) of phosphorus.

PREPARATIVE EXAMPLE P-1

A phosphorus- and sulfur-containing reaction product mixture was prepared by placing in a round bottom 4-neck flask equipped with a reflux condenser, a stirring bar and a nitrogen bubbler, 246 grams (1 mole) of hydroxyethyl-n-dodecyl sulfide, 122 grams (1 mole) of thiobisethanol, and 194 grams (1 mole) of dibutyl phosphite. The flask was flushed with nitrogen, sealed and the stirrer started. The contents were heated to 95° C. under vacuum (−60 KPa). The reaction temperature was maintained at 95° C. until approximately 59 mls of butyl alcohol were recovered as overhead in a chilled trap. Heating was continued until the TAN of the reaction mixture reached about 110. This continued heating took approximately 3 hours, during which time no additional butyl alcohol was evolved. The reaction mixture was cooled and 102 grams of a naphthenic base oil (e.g., Exxon Necton 37) added. The final product contained 5.2% phosphorus and 11.0% sulfur.

PREPARATIVE EXAMPLE P-2

A phosphorus- and sulfur-containing reaction product mixture was prepared by placing in a round bottom 4-neck flask equipped with a reflux condenser, a stirring bar and a nitrogen bubbler, 190 grams (1 mole) of hydroxyethyl-n-octyl sulfide, 154 grams (1 mole) of dithiodiglycol, and 194 grams (1 mole) of dibutyl phosphite. The flask was flushed with nitrogen sealed and the stirrer started. The contents were heated to 105° C. under vacuum (−90 KPa). The reaction temperature was maintained at between about 105 to 110° C. until approximately 54 mls of butyl alcohol were recovered as overhead in a chilled trap. Heating was continued until the TAN of the reaction mixture reached about 70. This continued heating took approximately 3 hours, during which time no additional butyl alcohol was evolved. The reaction mixture was cooled and analyzed for phosphorus and sulfur. The final product contained 6.4% phosphorus and 19.7% sulfur.

PREPARATIVE EXAMPLE P-3

A phosphorus- and sulfur-containing reaction product mixture was prepared by placing in a round bottom 4-neck flask equipped with a reflux condenser, a stirring bar and a nitrogen bubbler, 194 grams (1 mole) of dibutyl phosphite. The flask was flushed with nitrogen, sealed and the stirrer started. The dibutyl phosphite was heated to 150° C. under vacuum (−90 KPa). The temperature in the flask was maintained at 150° C. while 190 grams (1 mole) of hydroxyethyl-n-octyl sulfide was added over about one hour. During the addition approximately 35 mls of butyl alcohol were recovered as overhead in a chilled trap. Heating was continued for about one hour after the addition of the hydroxyethyl-n-octyl sulfide was completed, during which time no additional butyl alcohol was evolved. The reaction mixture was cooled and analyzed for phosphorus and sulfur. The final product had a TAN of 115 and contained 8.4% phosphorus and 9.1% sulfur.

Phosphorus Containing Ashless Dispersants

The phosphorus containing ashless dispersants useful with the present invention are produced by post-treating ashless dispersants with acids or anhydrides of phosphorus, and, optionally, boron. The ashless dispersants can be selected from hydrocarbyl succinimides, hydrocarbyl succinamides, mixed ester amides of hydrocarbyl substituted succinic acid, hydroxyesters of hydrocarbyl substituted succinic acids, Mannich condensation products of hydrocarbyl substituted phenols, formaldehyde and polyamines. Mixtures of dispersants can also be used. The preferred ashless dispersant are the polyisobutylene succinimides of polyamines such as tetraethylene pentamine. The polyisobutylene moieties preferably have molecular weights between about 300 to 3000. The ashless dispersants are further post-treated with sources of phosphorus and, optionally, boron. Suitable inorganic phosphorus acids and anhydrides which are useful in forming these products would include phosphorus acid, phosphoric acid, hypophosphoric acid, phosphorus trioxide, phosphorus tetraoxide, phosphoric anhydride. Partial and total sulfur analogs are preferably selected from phosphorotetrathioc acid, phosphoromonothioc acid, phosphorodithioc acid and phosphorotrithioc acid. The preferred phosphorus source is phosphorus acid. The preparation of these materials and their boronated analogs is well known, see for example U.S. Pat. No. 3,502,677 and U.S. Pat. No. 4,857,214, which are incorporated herein by reference.

PREPARATIVE EXAMPLE P4

Into a suitable vessel are placed 520 grams (approximately 0.12 mole) of the dispersant produced in Example D-1, 16 grams of phosphorus acid (0.20 moles), 16 grams of boric acid (0.25 moles), 7 grams of tolyltriazole (0.05 moles), 200 grams of naphthenic base oil (Exxon FN 1380) and 6 grams of water (0.33 moles). The mixture is stirred and the temperature raised to 100° C. and held at 100° C. for two hours. After the two hour heating period the temperature is raised to 110° C. and the pressure in the vessel reduced to −20 kPa. When water evolution ceased, after approximately 30 minutes, the mixture was cooled to room temperature and filtered to yield 760 grams (99%) of the phosphoborated dispersant. The product was found to contain 1.45% nitrogen; 0.72% phosphorus and 0.29% boron.

Zinc Dialkyldithiophosphates

The zinc dialkyldithiophosphates useful in the present invention are metal salts of thiophosphoric acids of the general formula:

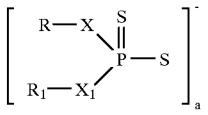

(V)

wherein X and $X_1$ are independently oxygen, sulfur or $CH_2$; R and $R_1$ are independently alkyl or alkylaryl of from about $C_1$ to $C_{20}$. R and $R_1$ may be linear or branched and may be bonded to X at either a primary or secondary carbon atom.

The acids used in the preparation of the metal salts employed in the lubricating compositions of this invention, and the metal salts themselves, are prepared by methods well known in the art.

Typical phosphorus-containing acids from which the metal salts of this invention may be prepared include, but are not limited to: dihydrocarbylphophinodithoic acids (V, $X{=}X_1{=}CH_2$); S-hydrocarbyl hydrogen hydrocarbylphosphonotrithioates (V, $X{=}CH_2$; $X_1{=}S$); O-hydrocarbyl hydrogen hydrocarbylphosphonodithioates (V, $X{=}CH_2$; $X_1{=}O$); S,S-dihydro-carbyl hydrogen phosphorotetrathioates (V, $X{=}X_1{=}S$); O,S-dihydrocarbyl hydrogen phosphorotrithioates (V, X=O; $X_1{=}S$) and O,O-dihydrocarbyl hydrogen phosphorodithioates (V, $X{=}X_1{=}O$), wherein O is oxygen and S is sulfur.

The preparation of these acids is well known in the art and is described in the patent literature and numerous other tests and publications. See for example the books, "Lubricant Additives," by C. V. Smallheer and R. K. Smith, published by Lezius-Hiles Co., Cleveland, Ohio (1967) and "Lubricant Additives," by M. W. Ranney, published by Noyes Data Corp., Parkridge, N.J. (1973), and the following U.S. Pat. Nos.: 2,261,047; 2,540,084; 2,838,555; 2,861,907; 2,862,947; 2,905,683; 2,952,699; 2,987,410; 3,004,996; 3,089,867; 3,151,075; 3,190,833; 3,211,648; 3,211,649; 3,213,020; 3,213,021; 3,213,022; 3,213,023; 3,305,589; 3,328,298; 3,335,158; 3,376,221; 3,390,082; 3,401,185; 3,402,188; 3,413,327; 3,446,735; 3,502,677; 3,573,293; 3,848,032; 3,859,300; 4,002,686; 4,089,793; 4,123,370; 4,308,154; 4,466,895; and 4,507,215. These books and patents are incorporated herein by reference.

The preferred acids are of structure V wherein $X{=}X_1{=}O$, and are readily prepared from the reaction of phosphorus pentasulfide and alcohols. The reaction involves mixing at a temperature of between about 20° C. to 200° C., 4 moles of the alcohol with one mole of phosphorus pentasulfide.

In general, the hydrocarbyl groups R and $R_1$, may contain at least 3 carbon atoms and up to about 20 carbon atoms. The preferred range is from about 3 to about 16 carbon atoms. Mixtures wherein R and $R_1$ are different are also useful. Typical examples of R and $R_1$ include isopropyl-, n-butyl-, n-pentyl-, 4-methyl-2-pentyl-, isooctyl-, n-dodecyl-, etc.

Methods for preparing the metal salts are well known and are described in detail in the patent literature. Most frequently, the salts are prepared by reacting one or more of the phosphorus-containing acids described above with a metal base. Suitable metal bases include the free metal, its oxide, hydroxide, alkoxide, and basic salts.

Also contemplated for use in the lubricating compositions of this invention are the metal salts of phosphorus-containing acids as described above, which have been post-treated by any number of other reagents to improve various properties. Examples include post-treatment with phosphites, epoxides, amines and the like. Such post-treatments and products so obtained are described in the following U.S. patents, which are incorporated herein by reference,: U.S. Pat. Nos. 3,004,996; 3,151,075; 3,211,648; 3,211,649; 3,213,020; 3,213,021; 3,213,022; 3,213,023; 4,263,150; 4,289,635; and 4,507,215.

Ashless Dispersant

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also useful are condensation products of polyamines and hydrocarbyl substituted phenyl acids. Mixtures of these dispersants can also be used.

Basic nitrogen containing ashless dispersants are well known lubricating oil additives, and methods for their preparation are extensively described in the patent literature. For example, hydrocarbyl-substituted succinimides and succinamides and methods for their preparation are described, for example, in U.S. Pat. Nos.: 3,018,247; 3,018,250; 3,018,291; 3,361,673 and 4,234,435, which are incorporated herein by reference. Mixed ester-amides of hydrocarbyl-substituted succinic acids are described, for example, in U.S. Pat. Nos.: 3,576,743; 4,234,435 and 4,873,009, which are incorporated herein by reference. Mannich dispersants, which are condensation products of hydrocarbyl-substituted phenols, formaldehyde and polyamines are described, for example, in U.S. Pat. Nos.: 3,368,972; 3,413,347; 3,539,633; 3,697,574; 3,725,277; 3,725,480; 3,726,882; 3,798,247; 3,803,039; 3,985,802; 4,231,759 and 4,142,980, which are incorporated herein by reference. Amine dispersants and methods for their production from high molecular weight aliphatic or alicyclic halides and amines are described, for example, in U.S. Pat. Nos.: 3,275,554; 3,438,757 and 3,565,804, which are incorporated herein by reference.

The preferred dispersants are the alkenyl succinimides and succinamides. The succinimide or succinamide dispersants can be formed from amines containing basic nitrogen and additionally one or more hydroxy groups. Usually, the amines are polyamines such as polyalkylene polyamines, hydroxy-substituted polyamines and polyoxyalkylene polyamines. Examples of polyalkylene polyamines include diethylene triamine, triethylene tetramine, tetraethylene pentamine, pentaethylene hexamine. Low cost poly (ethyleneamines) (PAM's) averaging about 5 to 7 nitrogen atoms per molecule are available commercially under trade names such as "Polyamine H", "Polyamine 400", "Dow Polyamine E-100", etc. Hydroxy-substituted amines include N-hydroxyalkyl-alkylene polyamines such as N-(2-hydroxyethyl)ethylene diamine, N-(2-hydroxyethyl)-piperazine, and N-hydroxyalkylated alkylene diamines of the type described in U.S. Pat. No. 4,873,009. Polyoxyalkylene polyamines typically include polyoxyethylene and polyoxypropylene diamines and triamines having average molecular weights in the range of between about 200 to 2500. Products of this type are available under the Jeffamine trademark.

The amine is readily reacted with the selected hydrocarbyl-substituted dicarboxylic acid material, e.g., alkylene succinic anhydride, by heating and oil solution containing between about 5 to 95 wt. % of the hydrocarbyl-substituted dicarboxylic acid material at between about 100° to 250° C., preferably between about 125° to 175° C., generally for between about 1 to 10 hours, more preferably 2 to 6 hours, until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from between about 0.1 to 1.0, preferably from between about 0.2 to 0.6, and more preferably between about 0.4 to 0.6, equivalents of dicarboxylic acid unit content (e.g., substituted succinic anhydride content) are used per reactive equivalent of nucleophilic reactant, e.g., amine. For example, about 0.8 mole of a pentamine (having two primary amino groups and five reactive equivalents of nitrogen per molecule) is preferably used to convert into a mixture of amides and imides, a composition, having a functionality of 1.6, derived from reaction of polyolefin and maleic anhydride, i.e., preferably the pentamine is used in an amount sufficient to provide about 0.4 equivalents (i.e., 1.6 divided by (0.8×5) equivalents) of succinic anhydride units per reactive nitrogen equivalent of the amine.

Use of alkenyl succinimides which have been treated with a boronating agent are also suitable for use in the compositions of this invention as they are much more compatible with elastomeric seals made from such substances as fluoroelastomers and silicon-containing elastomers. Dispersants may be post-treated with many reagents known to those skilled in the art. (see, e.g., U.S. Pat. Nos. 3,254,025, 3,502,677 and 4,857,214).

The preferred ashless dispersants are polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range between about 500 to 5000 (preferably between about 800 to 3000). The preferred dispersants are those produced by reacting polyisobutenyl-succinic anhydride with polyamines. The most preferred dispersants of this invention are those wherein the polyisobutene substituent group has a molecular weight of from between about 800 to 2000 atomic mass units and where the basic nitrogen containing moiety is polyamine (PAM).

The ashless dispersants of the invention can be used in any effective amount. However, they are typically used from between about 0.1 to 10.0 mass percent in the finished lubricant, preferably from between about 0.5 to 7.0 percent and most preferably from about between 2.0 to 5.0 percent.

EXAMPLE D-1

Preparation of Polyisobutylene Succinic Anhydride

A polyisobutenyl succinic anhydride having a succinic anhydride (SA) to polyisobutylene mole ratio (i.e., a SA:PIB ratio) of 1.04 is prepared by heating a mixture of 100 parts of polyisobutylene (940 Mn; Mw/Mn=2.5) with 13 parts of maleic anhydride to a temperature of about 220° C. When temperature reaches 120° C., the chlorine addition is begun and 10.5 parts of chlorine at a constant rate are added to the hot mixture for about 5.5 hours. The reaction mixture is then heat soaked at 220° C. for about 1.5 hours and then stripped with nitrogen for about one hour. The resulting polyisobutenyl succinic anhydride has an ASTM Saponification Number of 112. The PIBSA product is 90 wt. % active ingredient (A.I.), the remainder being primarily unreacted PIB.

Preparation of Dispersant

Into a suitable vessel equipped with a stirrer and nitrogen sparger are placed 2180 gms (approximately 2.1 moles) of the PIBSA produced above and 1925 grams of Exxon solvent 150 neutral oil. The mixture is stirred and heated under a nitrogen atmosphere. When the temperature reaches 149° C., 200 grams (approximately 1.0 mole) of Dow E-100 polyamine is added to the hot PIBSA solution over approximately 30 minutes. At the end of the addition a subsurface nitrogen sparge is begun and continued for an additional 30 minutes. When this stripping operation is complete, i.e., no further water is evolved, the mixture is cooled and filtered. The product contains 1.56% nitrogen.

Boration of Dispersant

One kilogram of the above produced dispersant is placed in a suitable vessel equipped with a stirrer and nitrogen sparger. The material is heated to 163° C. under a nitrogen atmosphere and 19.8 grams of boric acid are added over one hour. After all of the boric acid has been added a subsurface nitrogen sparge is begun and continued for 2 hours. After the 2 hour sparge the product is cooled and filtered to yield the borated dispersant. The product contains 1.5% nitrogen and 0.35% boron.

EXAMPLE D-2

Preparation of Polyisobutylene Succinic Anhydride

A polyisobutenyl succinic anhydride having a SA:PIB ratio of 1.13 to 1 is prepared by heating a mixture of 100 parts of polyisobutylene (2225 Mn; Mw/Mn=2.5) with 6.14 parts of maleic anhydride to a temperature of about 220° C. When the temperature reaches 120° C., the chlorine addition is begun and 5.07 parts of chlorine at a constant rate are added to the hot mixture for about 5.5 hours. The reaction mixture is then heat soaked at 220° C. for about 1.5 hours and then stripped with nitrogen for about one hour. The resulting polyisobutenyl succinic anhydride has an ASTM Saponification Number of 48. The PIBSA product is 88 wt. % active ingredient (A.I.), the remainder being primarily unreacted PIB.

Preparation of Dispersant

Into a suitable vessel equipped with a stirrer and nitrogen sparger are placed 4090 gms (approximately 1.75 moles) of the PIBSA produced above and 3270 grams of Exxon solvent 150 neutral oil. The mixture is stirred and heated under a nitrogen atmosphere. When the temperature reaches 149° C., 200 grams (approximately 1.0 mole) of Dow E-100 polyamine is added to the hot PIBSA solution over approximately 30 minutes. At the end of the addition a subsurface nitrogen sparge is begun and continued for an additional 30 minutes. When this stripping operation is complete, i.e., no further water is evolved, the mixture is cooled and filtered. The product contains 0.90% nitrogen.

Boration of Dispersant

One kilogram of the above produced dispersant is placed in a suitable vessel equipped with a stirrer and nitrogen sparger. The material is heated to 163° C. under a nitrogen atmosphere and 13.0 grams of boric acid are added over one hour. After all of the boric acid has been added, a subsurface nitrogen sparge is begun and continued for 2 hours. After the 2 hour sparge the product is cooled and filtered to yield the borated dispersant. The product contains 0.88% nitrogen and 0.23% boron.

Alkyl Primary Amine

The alkyl primary amine useful in the present invention are the alkyl primary amines represented by the following general formula:

$$R—NH_2$$

wherein R is a $C_8$ to $C_{30}$ alkyl, preferably a $C_{10}$ to $C_{18}$ alkyl.

These amines can be of either natural sources, i.e., derived from naturally occurring fats (tallow) or oils (cocoa), or synthetic sources. The alkyl groups are preferably linear, i.e., containing no side chains; provided, however, that they may have up to two methyl or ethyl side chains. The alkyl group may be saturated or unsaturated, i.e., containing double bonds, and may also contain hetero atoms such as oxygen or sulfur as long as they do not destroy the predominantly hydrocarbon nature of the group. The most preferable amines are the amines wherein the alkyl group R is a linear saturated hydrocarbon (e.g., n-octadecyl) or a linear hydrocarbon with one double bond (e.g., oleyl).

While any effective amount of the alkyl primary amine may be used to achieve the benefits of this invention, typically these effective amounts are from about 0.001 to 1.0 percent in the finished fluid, and preferably from about 0.005 to 0.5 percent and most preferably from 0.01 to 0.1 percent.

The alkyl primary amines of this invention are commercially available from a number of suppliers such as Akzo Nobel Inc. and Tomah Chemical Company. The amines useful in the present invention include, but are not limited to, oleyl amine, decyl amine, iso-decyl amine, dodecyl amine, tetradecylamine, octadecyl amine, eicosylamine, oleyl amine, cocoa amine, soya amine, tallow amine, hydrogenated tallow amine, stearyl amine, and iso-stearyl amine.

Amine Containing Friction Modifiers

Succinimides-Structure (VI)

The succinimide friction modifiers useful with the present invention are those produced from alkyl succinic acids and polyamines. These friction modifiers are represented by Structure VI:

(VI)

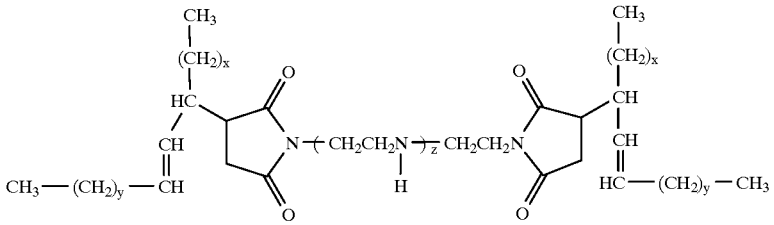

wherein: x and y are independent integers whose sum is from 1 to 30, and z is an integer from 1 to 10.

The starting components for forming the structure (VI) compounds are isomerized alkenyl succinic anhydrides which are prepared from maleic anhydride and internal olefins i.e., olefins which are not terminally unsaturated and therefore do not contain the following moiety:

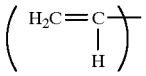

These internal olefins can be introduced into the reaction mixture as such, or they can be produced in-situ by exposing alpha-olefins to isomerization catalysts at high temperatures. A process for producing such materials is described in U.S. Pat. No. 3,382,172. The isomerized alkenyl substituted succinic anhydrides have the structure shown as structure (VII), where structure (VII) is represented by:

(VII)

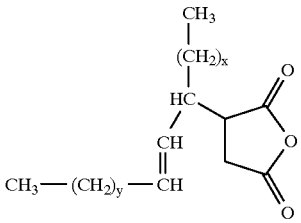

where x and y are independent integers whose sum is from 1 to 30.

The preferred succinic anhydrides are produced from isomerization of linear alpha-olefins with an acidic catalyst followed by reaction with maleic anhydride. The preferred alpha-olefins are 1-octene, 1-decene, 1-dodecene, 1-tetradecene, 1-hexadecene, 1-octadecene, 1-eicosane, or mixtures of these materials. The products described can also be produced from internal olefins of the same carbon numbers, i.e., 8 to 20. The preferred materials for this invention are those made from 1-tetradecene (x+y=9), 1-hexadecene (x+y=11) and 1-octadecene (x+y=13), or mixtures thereof.

The isomerized alkenyl succinic anhydrides are then further reacted with polyamines of structure (VIII), where structure (VIII) is represented by:

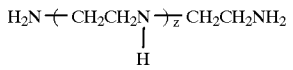

(VIII)

where z is an integer from 1 to 10, preferably from 1 to 4.

These are common polyethylene amines. When z=1 the material is diethylene triamine, when z=2 the material is triethylene tetramine, when z=3 the material is tetraethylene pentamine, for products where z>3 the products are commonly referred to as 'polyamine' or PAM. The preferred products of this invention employ diethylene triamine, triethylene tetramine, tetraethylene pentamine or mixtures thereof.

The isomerized alkenyl succinic anhydrides (VII) are typically reacted with the amines in a 2:1 molar ratio so that both primary amines are predominantly converted to succinimides. Sometimes a slight excess of isomerized alkenyl succinic anhydride (VII) is used to insure that all primary amines have reacted. The products of the reaction are shown as structure (VI).

The di-succinimides of structure (VI) may be further post-treated by any number of techniques known in the art. These techniques would include, but not be limited to: boration, maleation, acid treating with inorganic acids such as phosphoric, phosphorus, and sulfuric. Descriptions of these processes can be found in, for example, U.S. Pat. Nos. 3,254,025; 3,502,677; 4,686,054; and 4,857,214.

Another useful derivative of the succinimide friction modifiers are where the isomerized alkenyl groups of structures (VI) and (VII) have been hydrogenated to form their saturated alkyl analogs. These saturated versions of structures (VI) and (VII) may likewise be post-treated as previously described.

While any effective amount of the compounds of structure (VI) and its derivatives may be used to achieve the benefits of this invention, typically these effective amounts will range from between about 0.5 to 10, preferably from between about 2 to 7, most preferably from between about 3 to 6 weight percent of the finished fluid.

Examples for producing the structure (VI) compounds of the present invention are given below. These examples are intended for illustration and the present invention is not limited to the specific details set forth.

PREPARATIVE EXAMPLE FM-1

Into a one liter round bottomed flask fitted with a mechanical stirrer, nitrogen sweep, Dean Starke trap and condenser was placed 352 gm (1.00 mole) of iso-octadecenylsuccinic anhydride (ODSA from Dixie Chemical Co.). A slow nitrogen sweep was begun, the stirrer started and the material heated to 130° C. Immediately, 87 gm (0.46 moles) of commercial tetraethylene pentamine was added slowly through a dip tube to the hot stirred iso-octadecenylsuccinic anhydride. The temperature of the mixture increased to 150° C. where it was held for two hours. During this heating period 8 ml. of water (approximately 50% of theoretical yield) were collected in the Dean Starke trap. The flask was cooled to yield the product. Yield: 427 gm. Percent nitrogen: 7.2.

PREPARATIVE EXAMPLE FM-2

The procedure of Example A was repeated except that the following materials and amounts were used: iso-octadecenylsuccinic anhydride, 458 gm (1.3 moles), and; diethylenetriamine, 61.5 gm (0.6 m). The water recovered was 11 ml. Yield: 505 gm. Percent nitrogen: 4.97.

PREPARATIVE EXAMPLE FM-3

The procedure of Example A was repeated except that the following materials and amounts were used: iso-hexadecenylsuccinic anhydride (ASA-100 from Dixie Chemical Co.), 324 gm (1.0 mole), and; tetraethylenepentamine, 87 gm, 0.46 mole). The water recovered was 9 ml. Yield: 398 gm. Percent nitrogen: 8.1.

PREPARATIVE EXAMPLE FM-4

The product of Example A, 925 gm (1.0 mole), and 300 gm of a naphthenic base oil (EXXON Necton 37) were placed in a 2 liter flask fitted with a heating mantle, an overhead stirrer, nitrogen sweep and condenser. The temperature of the mixture was raised to 80° C., the stirrer started and a nitrogen sweep begun. To this hot solution maleic anhydride, 98 gm (1.0 mole), was added slowly over about 20 minutes. Once the addition was complete the temperature was raised to 150° C. and held for 3 hours. The product was cooled and filtered. Yield: 1315 gm. Percent nitrogen: 5.2%.

EXAMPLE FM-5

The product of Example A, 925 gm (1.0 mole), and 140 gm of a naphthenic base oil (EXXON Necton 37) and 1 gm of DC-200 anti-foamant were placed in a 2 liter round bottomed flask fitted with a heating mantle, an overhead stirrer, nitrogen sweep, Dean Starke trap and condenser. The solution was heated to 80° C. and 62 gm (1.0 mole) of boric acid was added. The mixture was heated to 140° C. and held for 3 hours. During this heating period 3 ml. of water were collected in the Dean Starke trap. The product was cooled and filtered. Yield: 1120 gm. Percent nitrogen: 6.1; percent boron: 0.9

Amides

The amide containing friction modifiers useful in the present invention are the amides produced by reacting long chain carboxylic acids with polyamines. These amides are represented by Structure IX, where structure IX is:

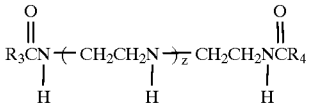

(IX)

wherein: $R_3$ and $R_4$ are independently $C_8$ to $C_{30}$ alkyl groups and z is an integer from 1 to 10.

The carboxylic acids useful in preparing the amides are long chain carboxylic acids where the alkyl chain is either linear or branched. Typical carboxylic acids are decanoic acid, dodecanoic acid, tetradecanoic acid, octadecanoic acid, eicosanoic acid, stearic acid, iso-stearic acid, oleic acid, myristic acid and other mono-carboxylic acids or mixtures of mono-carboxylic acids.

The amines useful in the preparation of the amide friction modifiers of the present invention are the polyamines of structure VIII previously described.

The amides are prepared by contacting the mono carboxylic acids with the polyamines at elevated temperatures. The temperatures can range from 40° C. to 200° C. and are normally 100 to 150° C. The ratio of mono carboxylic acid to polyamine is normally 2 to 1, such that all primary amine groups are reacted. However, it is often useful to add excess carboxylic acid to react with one or more of the secondary amines in the di-amide.

The preferred amides are the di-amides produced from polyamines and natural mono carboxylic acids such as oleic acid, stearic acid and iso-stearic acid. The preferred polyamines are 'polyamine' (PAM) and tetraethylene pentamine (Structure VIII, z=3). The preferred di-amides are those produced from oleic acid and tetraethylene pentamine and iso-stearic acid and tetraethylene pentamine.

The concentration of the amide friction modifiers is typically from about 0.01 to 5.0 mass percent in the final lubricant. A more preferred concentration range is from about 0.1 to 3.0 mass percent and the most preferred is from about 0.1 to 1.0 mass percent.

Alkoxylated Amines

The alkoxylated amines useful in the current invention are those produced by reacting a long chain primary amine with a low molecular weight alkoxide such as ethylene oxide or propylene oxide. The alkoxylated amine friction modifiers of the current invention are represented by Structure X, where structure X is:

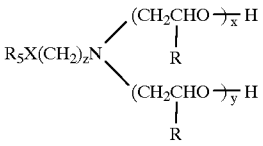

(X)

wherein: $R_5$ is a $C_3$ to $C_{30}$ alkyl group; X=$CH_2$, oxygen or sulfur; z=1 to 6; R=H, $CH_3$— or $CH_3CH_2$—; and x and y are independently integers from 0 to 10 provided that x+y>1.

The alkoxylated amine friction modifiers of the present invention are well known in the art and are most easily prepared by contacting the primary amine with ethylene or propylene oxide at elevated temperatures and pressures.

One type of preferred products are produced from the linear alkyl amines and ethylene oxide (Structure X, X=$CH_2$, z=1, R=H and x=y=1). Examples of such products would include N,N-Diethoxydodecyl amine; N,N-diethoxy-tetradecyl amine, N,N-diethoxy-octadecylamine, etc. Products of this type are available from Tomah Chemical Co. and Akzo Nobel Inc.

A second type of preferred products are those produced from ether amines and ethylene oxide (Structure X, X=O, z=3, R=H and x=y=1). Examples of such products would include N,N-bis(2-hydroxyethyl)-n-dodecyloxypropylamine; N,N-bis(2-hydroxyethyl)-stearyloxypropylamine; N,N-bis(2-hydroxylethyl)-hexadecyloxypropylamine. Products of this type are available from Tomah Chemical Co.

The alkoxylated amines of the present invention are normally used at a concentration of from between about 0.01% to 2.0% in the finished fluid. More preferably, they are used at concentrations from between about 0.05% to 1.0% and most preferably at concentrations from between about 0.025 to 0.5%.

Other additives known in the art may be added to the power transmitting fluids of this invention. These additives include dispersants, antiwear agents, corrosion inhibitors, detergents, extreme pressure additives, and the like. They are typically disclosed in, for example, "Lubricant Additives" by C. V. Smallheer and R. Kennedy Smith, 1967, pp. 1–11 and U.S. Pat. No. 4,105,571.

Representative amounts of these additives in an ATF are summarized as follows:

| Additive | (Broad) Wt. % | (Preferred) Wt. % |
|---|---|---|
| VI Improvers | 1–12 | 1–4 |
| Corrosion Inhibitor | 0.01–3 | 0.02–1 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.1–8 | 0.5–5 |
| Lubricating Oil | Balance | Balance |

The additive combinations of this invention may be combined with other desired lubricating oil additives to form a concentrate. Typically, the active ingredient (a.i.) level of the concentrate will range from between about 20 to 90, preferably from between about 25 to 80, most preferably from between about 35 to 75 weight percent of the concentrate. The balance of the concentrate is a diluent typically comprised of a lubricating oil or solvent.

The following examples are given as specific illustrations of the claimed invention. It should be understood, however, that the invention is not limited to the specific details set forth in the examples. All parts and percentages are by weight unless otherwise specified.

EXAMPLES 1–10

The method used in these examples to determine $\Delta\mu/\Delta v$ consists of making measurements of friction coefficient versus sliding speed using a Low Velocity Friction Apparatus (LVFA). This technique is described in detail in references such as, "Friction of Transmission Clutch Materials as Affected by Fluids, Additives and Oxidation", Rodgers, J. J. and Haviland, M. L., Society of Automotive Engineers paper 194A, 1960 and "Prediction of Low Speed Clutch Shudder in Automatic Transmissions Using the Low Velocity Friction Apparatus", Watts, R. F. and Nibert, R. K., Engine Oils and Automotive Lubrication, Marcel Dekker, New York (1992) 732, both of which are incorporated herein by reference. The data reported in the following examples was generated as described in the second reference using D530-70 (manufactured by Dynax Corporation of Japan) friction material.

To illustrate the present invention ten automatic transmission fluids were blended in solvent neutral oil (SN75) to typical automatic transmission fluid viscometrics. Each fluid contained a base additive consisting of anti-oxidants, viscosity modifiers, corrosion inhibitors, anti-foamants and a friction modifier capable of delivering the required long term friction characteristics to the fluid.

Each fluid in turn had its $\Delta\mu/\Delta v$ measured at 120° C., new, after aging at 120° C. for 20 minutes and after aging at 120° C. for 180 minutes. The results of this testing are shown in Tables 1 and 2.

TABLE 1

BREAK-IN IMPROVEMENT

| Component | Product of Example | 1 | 2 | 3 | 4 | 5 | 6 | 7 | 8 |
|---|---|---|---|---|---|---|---|---|---|
| Base Additive Package | | 4.00 | 4.00 | 4.00 | 4.00 | 4.00 | 4.00 | 4.00 | 4.00 |
| Dispersant | | | | | | | | | |
| 950 MW PIBSA | D-1 | | | 3.25 | 3.25 | | | 3.25 | 3.25 |
| 2225 MW PIBSA | D-2 | 3.20 | 3.20 | | | | | | |
| Phosphorus Source | | | | | | | | | |
| Phosphite | P-1 | 0.36 | 0.36 | | | | | | |
| Phosphite | P-2 | | | 0.40 | 0.40 | | | | |
| $H_3PO_3$ Treated Dispersant | P-4 | | | | | 4.00 | 4.00 | | |
| Trilauryltrithiophosphite | | | | | | | | 0.60 | 0.60 |
| Friction Modifier | | | | | | | | | |
| Succinimide | FM-2 | 3.00 | 3.00 | 2.00 | 2.00 | 3.00 | 3.00 | 3.00 | 3.00 |
| Break-in Friction Modifier | | | | | | | | | |
| ARMEEL OL | | 0 | 0.05 | 0 | 0.05 | 0 | 0.05 | 0 | 0.05 |
| $\Delta\mu/\Delta v$ | | | | | | | | | |
| New | | −6.70 | 4.50 | −8.30 | 0.50 | 0.90 | 6.20 | 0.20 | 1.20 |
| @ 20 minutes | | −6.40 | 2.60 | −4.30 | 2.60 | 0.20 | 10.20 | −0.50 | 0.50 |
| @ 180 minutes | | −2.40 | 1.90 | −7.80 | −1.00 | 2.60 | 8.80 | 4.00 | 4.30 |

TABLE 2

EFFECT OF CONCENTRATION

| Component | Product of Example | 1 | 2 | 9 | 10 |
|---|---|---|---|---|---|
| Base Additive Package | | 4.00 | 4.00 | 4.00 | 4.00 |
| Dispersant | | | | | |
| 2225 MW PIBSA | D-2 | 3.20 | 3.20 | 3.20 | 3.20 |
| Phosphorus Source | | | | | |
| Phosphite | P-1 | 0.36 | 0.36 | 0.36 | 0.36 |
| Friction Modifier | | | | | |
| Succinimide | FM-2 | 3.00 | 3.00 | 3.00 | 3.00 |
| Break-in Friction Modifier | | | | | |
| ARMEEL OL | | 0 | 0.05 | 0.03 | 0.10 |
| $\Delta\mu/\Delta v$ | | | | | |
| New | | −6.70 | 4.50 | 2.80 | 16.70 |
| @ 20 minutes | | −6.40 | 2.60 | −1.00 | 14.70 |
| @ 180 minutes | | −2.40 | 1.90 | 0.20 | 11.70 |
| Static Friction Coefficient | | 0.124 | 0.116 | 0.103 | 0.076 |

The data in Table 1 was obtained by measuring the friction characteristics as described above on eight fluids of varying composition. The eight fluids represent two different ashless dispersant types, and four different phosphorus sources. The data in Table 1 is set up in pairs, a fluid without the break-in improving material of the present invention is compared to an identical fluid with the added aliphatic primary amine. In each case, the fluid with the aliphatic primary amine (Fluids 2, 4, 6 and 8) have significantly more positive (higher) $\Delta\mu/\Delta v$ than the comparable fluid without it (Fluids 1, 3, 5 and 7). The other important characteristic of the present invention is that with aging, i.e., longer running time, the effect of the added break-in friction modifier slowly disappears. This is shown by comparing the data with the break-in additive to the data without. In each case the break-in friction modifier containing fluids (e.g., those set forth in Table 1, col. 2, 4, 6, and 8 which comprise ARMEEL OL alkyl long chain amines) have a more positive $\Delta\mu/\Delta v$, however, that difference decreases with running time so that eventually all of the effect of the break-in improving additive will be gone.

The data in Table 2 was generated by using Fluids 1 and 2 in Table 1 and adding two additional concentrations of the break-in friction modifier. As break-in friction modifier concentration is increased, going from Fluid 1 to Fluid 4, the $\Delta\mu/\Delta v$ becomes more positive. However, the static friction also drops as shown in the last section of Table 2. If the static friction coefficient gets too low, as with Fluid 4, the transmission quite likely will experience problems with shifting clutch holding capacity. Therefore, there is an upper limit on the amount of the break-in improving friction modifier that can be added to the fluid. Table 2 demonstrates that 0.10% by weight of the break-in friction modifier ARMEEL OL exhibits an undesirably low level of static friction coefficient, i.e., 0.076.

This data shows that the compositions of the present invention employing long chain alkyl primary amines do provide improved frictional break-in characteristics. And, that with running time this effect disappears so as not to interfere with the long term frictional performance of the fluid.

What is claimed is:

1. A power transmission fluid composition comprising:

(a) a major amount of lubricating oil;

(b) an oil soluble phosphorous compound, wherein said oil soluble phosphorous compound is selected from the group consisting of (i) a mixture of mono and di-alkyl phosphites wherein said alkyl groups contain thioether linkages, and (ii) an ashless dispersant reacted with phosphorus ester, phosphorous-based acid, or a mixture thereof;

(c) an ashless dispersant; and (d) an amine having the following structure I: R—$NH_2$ wherein R is about a $C_8$ to $C_{30}$ alkyl.

2. The composition according to claim 1 further comprising an amine containing friction modifier.

3. The composition according to claim 1 wherein the amine of structure I is decyl amine, iso-decyl amine, dodecyl amine, tetradecylamine, octadecyl amine, eicosylamine, oleyl amine, cocoa amine, soya amine, tallow amine, hydrogenated tallow amine, stearyl amine, and iso-stearyl amine.

4. The composition according to claim 1 wherein the R in said amine of structure I is about a $C_{10}$ to $C_{18}$ alkyl.

5. The composition according to claim 2 wherein said amine containing friction modifier is at least one compound selected from the group consisting of: the di-(-iso-stearyl amide) of tetraethylene pentamine, the di-(iso-octadecenyl succinimide) of diethylene triamine, and N,N-bis(2-hydroxylethyl)-hexadecyloxypropylamine.

6. The composition according to claim 1 wherein said power transmission fluid is selected from the group consisting of: automatic transmission fluids, hydraulic fluids, heavy duty hydraulic fluids, industrial oils, power steering fluids, pump oils, tractor fluids, and universal tractor fluids.

7. The composition according to claim 1 wherein said lubricating oil is a synthetic oil or a mixture of synthetic and natural mineral oils.

8. The composition according to claim 1 further comprising additional additives selected from the group consisting of: viscosity index improvers, corrosion inhibitors, dispersants, antifoaming agents, detergents, antiwear agents, pour point depressants, and seal swellants.

9. The composition according to claim 1 wherein said lubricating oil has a kinematic viscosity of from about between about 1 $mm^2/s$ to 100 $mm^2/s$ at 100° C.

10. A power transmission fluid composition that comprises the product formed by adding the following components:

(a) a major amount of lubricating oil;

(b) an oil soluble phosphorus compound, wherein said oil soluble phosphorous compound is selected from the group consisting of (i) a mixture of mono and di-alkyl phosphites wherein said alkyl groups contain thioether linkages, and (ii) an ashless dispersant reacted with phosphorus ester, phosphorous-based acid, or a mixture thereof; and (c) an amine having the following structure I: R—$NH_2$ wherein R is about a $C_8$ to $C_{30}$ alkyl.

11. The composition according to claim 10 further comprising an amine containing friction modifier.

12. The composition according to claim 10 wherein the amine of structure I is decyl amine, iso-decyl amine, dodecyl amine, tetradecylamine, octadecyl amine, eicosylamine, oleyl amine, cocoa amine, soya amine, tallow amine, hydrogenated tallow amine, stearyl amine, and iso-stearyl amine.

13. The composition according to claim 10 wherein the R in said amine of structure I is about a $C_{10}$ to $C_{18}$ alkyl.

14. The composition according to claim 11 wherein said amine containing friction modifier is at least one compound selected from the group consisting of: the di-(-iso-stearyl amide) of tetraethylene pentamine, the di-(iso-octadecenyl succinimide) of diethylene triamine, and N,N-bis(2-hydroxylethyl)-hexadecyloxypropylamine.

15. The composition according to claim 10 wherein said lubricating oil is a synthetic oil or a mixture of synthetic and natural mineral oils.

16. The composition according to claim 10 further comprising additional additives selected from the group consisting of: viscosity index improvers, corrosion inhibitors, dispersants, antifoaming agents, detergents, antiwear agents, pour point depressants, and seal swellants.

17. The composition according to claim 10 wherein said power transmission fluid is selected from the group consisting of: automatic transmission fluids, hydraulic fluids, heavy duty hydraulic fluids, industrial oils, power steering fluids, pump oils, tractor fluids, and universal tractor fluids.

18. The composition according to claim 10 wherein said lubricating oil has a kinematic viscosity of from about between about 1 $mm^2/s$ to 100 $mm^2/s$ at 100° C.

19. A method for eliminating or substantially reducing green shudder in power transmissions which comprises: adding to a power transmission during initial fill a power transmission fluid composition comprising:

(a) a major amount of lubricating oil;

(b) an oil soluble phosphorous compound, wherein said oil soluble phosphorous compound is selected from the group consisting of (i) a mixture of mono and di-alkyl phosphites wherein said alkyl groups contain thioether linkages, and (ii) an ashless dispersant reacted with phosphorus ester, phosphorous-based acid, or a mixture thereof;

(c) an ashless dispersant; and (d) an amine having the following structure I: R—$NH_2$ wherein R is about a $C_8$ to $C_{30}$ alkyl.

20. A method for eliminating or substantially reducing green shudder in power transmissions which comprises: adding to a power transmission during initial fill a power transmission fluid composition that comprises the product formed by adding the following components:

(a) a major amount of lubricating oil;

(b) an oil soluble phosphorus compound, wherein said oil soluble phosphorous compound is selected from the group consisting of (i) a mixture of mono and di-alkyl phosphites wherein said alkyl groups contain thioether linkages, and (ii) an ashless dispersant reacted with phosphorus ester, phosphorous-based acid, or a mixture thereof; and (c) an amine having the following structure I: R—$NH_2$ wherein R is about a $C_8$ to $C_{30}$ alkyl.

21. The composition according to claim 1 wherein said thioether linkage is selected from the group consisting of 3-thio-heptyl, 3-thio-nonyl, 3-thio-undecyl, 3-thio-tridecyl, 5-thio-hexadecyl, and 8-thio-octadecyl.

22. The composition according to claim 10 wherein said thioether linkage is selected from the group consisting of 3-thio-heptyl, 3-thio-nonyl, 3-thio-undecyl, 3-thio-tridecyl, 5-thio-hexadecyl, and 8-thio-octadecyl.

* * * * *